US010468843B2

(12) United States Patent
Schaper

(10) Patent No.: US 10,468,843 B2
(45) Date of Patent: Nov. 5, 2019

(54) LOOP BRIDGE FOR LOOPING THROUGH A NUMBER OF ELECTRICAL SIGNALS

(71) Applicant: Phoenix Contact GmbH & Co. KG, Blomberg (DE)

(72) Inventor: Elmar Schaper, Lügde (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 16/060,990

(22) PCT Filed: Dec. 5, 2016

(86) PCT No.: PCT/EP2016/079785
§ 371 (c)(1),
(2) Date: Jun. 11, 2018

(87) PCT Pub. No.: WO2017/097721
PCT Pub. Date: Jun. 15, 2017

(65) Prior Publication Data

US 2018/0366894 A1 Dec. 20, 2018

(30) Foreign Application Priority Data

Dec. 11, 2015 (DE) ..... 10 2015 121 618

(51) Int. Cl.
*H01R 31/08* (2006.01)
*H01R 9/24* (2006.01)

(52) U.S. Cl.
CPC ..... *H01R 31/08* (2013.01); *H01R 9/2491* (2013.01)

(58) Field of Classification Search
CPC ..... H01R 31/08; H01R 9/2491; H01R 12/79; H05K 1/118
(Continued)

(56) References Cited

U.S. PATENT DOCUMENTS 5,345,364 A 9/1994 Biernath
5,701,086 A * 12/1997 Wardwell ..... G01R 1/0425 324/756.05
(Continued)

FOREIGN PATENT DOCUMENTS

DE 42 28 025 C2 11/1995
DE 195 42 628 C1 2/1997
(Continued)

*Primary Examiner* — Jean F Duverne
(74) *Attorney, Agent, or Firm* — Holland & Hart LLP

(57) ABSTRACT

The disclosure relates to a loop bridge for looping through a number of electrical signals, comprising: a first electric module comprising a plurality of first electric connections, wherein the plurality of electrical signals are looped through the first electric module to a second electric module comprising a number of second electric connections; and a comb-shaped conducting element comprising a number of first prongs and a number of second prongs, wherein the first prongs are configured to be inserted into the first electric connections and the second prongs are configured to be inserted into the second electric connections, wherein the first prongs are connected to the second prongs in an electrically conductive manner, and wherein the first prongs and the second prongs are configured to be elastically deformed to be retained in a force-locking manner in the first and second electric connections, respectively.

19 Claims, 8 Drawing Sheets

(58) Field of Classification Search
USPC ..... 439/511
See application file for complete search history.

(56) References Cited

U.S. PATENT DOCUMENTS

| | | | | |
|---|---|---|---|---|
| 5,741,148 | A * | 4/1998 | Biernath | H01R 12/79 439/284 |
| 6,699,395 | B1 * | 3/2004 | Svenkeson | H05K 1/118 216/13 |
| 7,160,145 | B2 * | 1/2007 | Barrat | H01R 9/2675 439/511 |

FOREIGN PATENT DOCUMENTS

| | | | |
|---|---|---|---|
| DE | 10 2004 018553 | A1 | 11/2005 |
| DE | 20 2013 009083 | U1 | 12/2013 |
| DE | 10 2013 114 651 | A | 6/2015 |
| EP | 0 712 267 | A2 | 5/1996 |

* cited by examiner

LOOP BRIDGE FOR LOOPING THROUGH A NUMBER OF ELECTRICAL SIGNALS

CROSS-REFERENCE TO RELATED APPLICATIONS

This application is a 371 national phase filing of International Application No. PCT/EP2016/079785, entitled "LOOPING BRIDGE FOR LOOPING THROUGH A NUMBER OF ELECTRIC SIGNALS", filed 5 Dec. 2016, which claims priority to German Patent Application No. 10 2015 121 618.3, entitled "SCHLEIFENBRÜCKE ZUM DURCHSCHLEIFEN EINER ANZAHL VON ELEKTRISCHEN SIGNALEN", filed 11 Dec. 2015.

BACKGROUND

The disclosure relates to a loop bridge for looping through a number of electrical signals.

In order to transmit electrical signals, such as a supply voltage, to the electric connections of an electric module, connecting cables, such as insulated copper wires with a cross-sectional area of 1.5 mm2, often are used. Looping through one of these electrical signals to an electric connection of another electric module frequently is achieved by inserting the respective end portions of two connecting cables into a connecting device, such as a twin-wire ferrule, in order to electrically connect the connecting cables. The electrical contact between the connecting device and an electric connection of the electric module thereby facilitates the looping through of one of the electrical signals to an electric connection of the other electric module.

However, inserting the end portions of the connecting cables into the connecting device is intricate and time-consuming, especially if a plurality of electrical signals is looped through to the electric connections of a plurality of other electric modules. A prefabricated loop bridge may be used for this purpose, wherein said loop bridge facilitates the looping through of the electrical signals to the electric connections of a defined number of electric modules. One problem in this context is the mechanical stability of mounting the loop bridge to the connections.

SUMMARY

The object underlying the disclosure is to provide an improved loop bridge for looping through electric signals.

This object is achieved by the subject matters with the characteristics according to the independent claims. Advantageous examples of the disclosure are the subject matter of the drawings, the description and the dependent claims.

The disclosure is based on the finding that the aforementioned object may be achieved through flexible and/or elastically deformable prongs, which, due to their elasticity, are retained in a force-locking manner in the connections and which subsequently may be released again.

The flexible prongs force the force-locking fit in the connections via, for example, lateral pressure exerted by the prongs against the interior walls of the connections, or by the prongs' being clamped in the connections due to the elasticity of the prongs. Thus, the prongs are locked into the connection in a particularly advantageous manner.

According to a first aspect of the disclosure, the object is achieved by a loop bridge for looping through a number of electrical signals from a first electric module with a corresponding number of first electric connections to a second electric module with an identical number of second electric connections, the disclosure comprising: a comb-shaped conducting element with that same number of first prongs and second prongs, wherein the first prongs can be inserted into the first electric connections and the second prongs can be inserted into the second electric connections, and wherein the first prongs are connected to the second prongs in an electrically conductive manner. The first prongs are elastically deformable for the purpose of being retained in the first electric connections in a force-locking manner, and the second prongs are elastically deformable for the purpose of being retained in the second electric connections in a force-locking manner. One technical advantage thus achieved is that the disclosure provides an easily mountable loop bridge for looping through a number of electrical signals, which is retained in the connections in a force-locking manner—for example, by jamming—due to the prongs' elastic deformability.

The number of electrical signals may be a whole number. Examples are the numbers 1, 2, 3, 4, 5, 10 or 25. Furthermore, the number may correspond to a number of poles.

The electrical signals may be control signals used to control the respective electric modules. Furthermore, the electrical signals may be phase signals of a multi-phase signal. One example of a multi-phase signal is a multi-phase supply voltage.

The respective electric module may be a control module for a device, such as a hybrid motor starter and/or a motor manager.

The respective electric module also may be, or may comprise, an electric connection module, specifically a terminal block.

The respective electric connections may be connection terminals of the respective electric module.

The comb-shaped conducting element may be formed by a comb-shaped circuit board or a comb-shaped lead frame. The comb-shaped conducting element also may be specially designed connector circuit board or a circuit board.

The comb-shaped conducting element may be of a single-piece design comprising one circuit board or a multi-piece design comprising two circuit boards.

The respective circuit board preferably is electrically insulated and consists of FR4 material, for example.

In one advantageous example, at least one prong includes, or all prongs include, an aperture in the center of the prong, wherein this prong aperture is limited on its sides by curved side walls, and wherein the curved side walls are elastically deformable. Thereby, the elastic deformability of the prongs is achieved in particularly simple fashion. The prongs' prong apertures may be punched out, for example.

In one advantageous example, the prong aperture is completely enclosed by the curved side walls, or the prong aperture includes an opening on its end, specifically on the side of the prong facing away from the comb-shaped conducting element. Thereby, the elastic deformability of the prongs is achieved in particularly simple fashion. If an end-side opening is provided for the prong aperture, the prong can be designed in an elastic fork shape.

In one advantageous example, the side walls can be elastically displaced during the insertion of the prong into a connection and can at least partially expand once inside the connection. Thereby, the force-locking retention of the prong in the connection is achieved without the need to arrange a locking catch on the connection.

In one advantageous example, the side walls curve outward in an arched shape or triangular shape or flat shape. Thereby, the side walls are compressed during the insertion of the respective prongs into the respective connection and will elastically push against the interior walls after the insertion, specifically against the side walls, thus causing their being retained in the connection in a force-locking manner.

In one advantageous example, the comb-shaped conducting element is of a single-piece design comprising a comb-shaped circuit board, on which the first prongs and the second prongs are formed. The comb-shaped circuit board is made from FR4, for example, such that the first prongs are insulated from each other and the second prongs are insulated from each other.

In one advantageous example, the comb-shaped conducting element includes a first comb-shaped circuit board and a second comb-shaped circuit board, wherein the first comb-shaped circuit board comprises first partial prongs and second partial prongs, and wherein the second comb-shaped circuit board comprises first partial prongs and second partial prongs, and wherein the first comb-shaped circuit board and the second comb-shaped circuit board are positioned on top of each other such that the first partial prongs of the first comb-shaped circuit board and of the second comb-shaped circuit board are at least partially positioned on top of each other, wherein the respective pairs of first partial prongs positioned on top of each other form first prongs, and such that the second partial prongs of the first comb-shaped circuit board and of the second comb-shaped circuit board are at least partially positioned on top of each other, wherein the respective pairs of second partial prongs positioned on top of each other form second prongs.

The partial prongs positioned on top of each other may be located a lateral distance apart from each other, such that they can be compressed when inserted into the respective connection and such that they subsequently again push against the interior walls of the respective connection, thus being retained in a force-locking manner.

In one advantageous example, the respective partial prongs are elastically deformable, specifically, they can be compressed and subsequently expanded again, wherein the respective partial prongs positioned on top of each other are offset against each other, such that a prong formed by partial prongs positioned on top of each other may be compressed, specifically when inserted into a connection. The partial prongs positioned on top of each other expand again once inside the connection and are thus retained in a force-locking manner.

In one advantageous example, the prongs positioned on top of each other are moveable or displaceable in relation to each other. Thereby, the partial prongs can be displaced individually, which causes their being retained in a force-locking manner.

In one advantageous example, each respective partial prong includes a lateral curvature, such that the lateral curvatures of partial prongs positioned on top of each other face away from each other, resulting in the prong being retained in a force-locking manner.

In one advantageous example of the loop bridge, the first prongs are connected to the respective second prongs in pairs in an electrically conductive manner, such that each respective prong of the first prongs is connected to a respective prong of the second prongs in an electrically conductive manner. One of the technical advantages thus achieved is that the number of electrical signals can efficiently be looped through from the first electric module to the second electric module.

In one advantageous example, the first prongs are electrically insulated from each other and the second prongs are electrically insulated from each other. Thus, each respective prong of the first prongs or second prongs can be assigned different signals or electric potentials.

In another advantageous example of the loop bridge, the prongs are rectangular or rounded. One of the technical advantages thus achieved is that the prongs can efficiently be inserted into the respective electric connections.

In another advantageous example of the loop bridge, each respective prong includes an electric contact surface for contacting an electric connection. One of the technical advantages thus achieved is that the prongs can efficiently make electric contact with the respective electric connections.

The electric contact surface may be formed by a copper layer arranged on the comb-shaped conducting element. Furthermore, the electric contact surface can be a connection surface.

In another advantageous example of the loop bridge, adjacent prongs are spaced apart by a recess, specifically a rectangular or rounded recess, which is designed to accept a bar on the housing of the respective electric module, wherein the bar is located between two adjacent electric connections. One of the technical advantages thus achieved is that the respective prongs can be inserted form-fittingly into the electric connections of the respective electric module.

The recess furthermore may be designed to accept the housing of the respective electric module between two adjacent electric connections.

Furthermore, the comb-shaped conducting element or circuit board may form-fittingly slot into the electric connections of the respective electric module or terminal.

In another advantageous example of the loop bridge, the comb-shaped conducting element is formed by a comb-shaped circuit hoard. One of the technical advantages thus achieved is that the comb-shaped conducting element is formed efficiently.

In another advantageous example of the loop bridge, the comb-shaped circuit board includes a flexible circuit board portion, which flexibly connects a first circuit board portion comprising the first prongs with a second circuit board portion comprising the second prongs. One of the technical advantages thus achieved is that a possible height difference between the first electric module and the second electric module can be compensated for.

The flexible circuit board portion may be formed or realized by a Flex circuit board. Furthermore, the flexible circuit board portion may be designed to compensate for vibrations of the respective electric module.

In another advantageous example of the loop bridge, the flexible circuit board portion is molded together with the first circuit board portion and the second circuit board portion. One of the technical advantages thus achieved is that the respective circuit board portions are joined together in an efficient manner.

In another advantageous example of the loop bridge, the flexible circuit board is formed in an S-shape or a U-shape. One of the technical advantages thus achieved is that the length of the loop bridge can be adjusted to match the distance between the first electric module and the second electric module.

In another advantageous example of the loop bridge, the respective prongs include electric contact surfaces on both their top and their bottom sides for making electric contact with an electric connection or with a prong of the other comb-shaped conducting element. One of the technical advantages thus achieved is that the loop bridge can be mounted very easily.

In another advantageous example of the loop bridge, the electric signals are phase signals of a multi-phase signal. One of the technical advantages thus achieved is that a multi-phase supply voltage can be looped through from the first electric module to the second electric module in an efficient manner.

According to a second aspect of the disclosure, the object is achieved by a connection arrangement for looping through a number of electric signals, the arrangement comprising: a first electric module with a corresponding number of first electric connections; a second electric module with an identical number of second electric connections; and the loop bridge comprising a comb-shaped conducting element with that same number of first prongs and second prongs; wherein the first prongs are inserted into the first electric connections and the second prongs into the second electric connections, connecting the first electric connections to the second electric connections in respective pairs in an electrically conductive manner, such that each electric connection of the first electric connections is connected to the respective electric connection of the second electric connections in an electrically conductive manner. The first prongs are retained in a force-locking manner in the first electric connections and the second prongs are retained in a force-locking manner in the second connections.

One of the technical advantages thus achieved is that the number of electrical signals can be looped through from the first electric module to the second electric module in an efficient manner and that the prongs cause an improved retention in the connections at the same time.

Furthermore, the respective electric module may comprise, or may be, an electric connection module, specifically a terminal block.

BRIEF DESCRIPTION OF THE DRAWINGS

Examples of the present disclosure are shown in the drawings and are described in more detail in the following.

DETAILED DESCRIPTION

Figure 1:
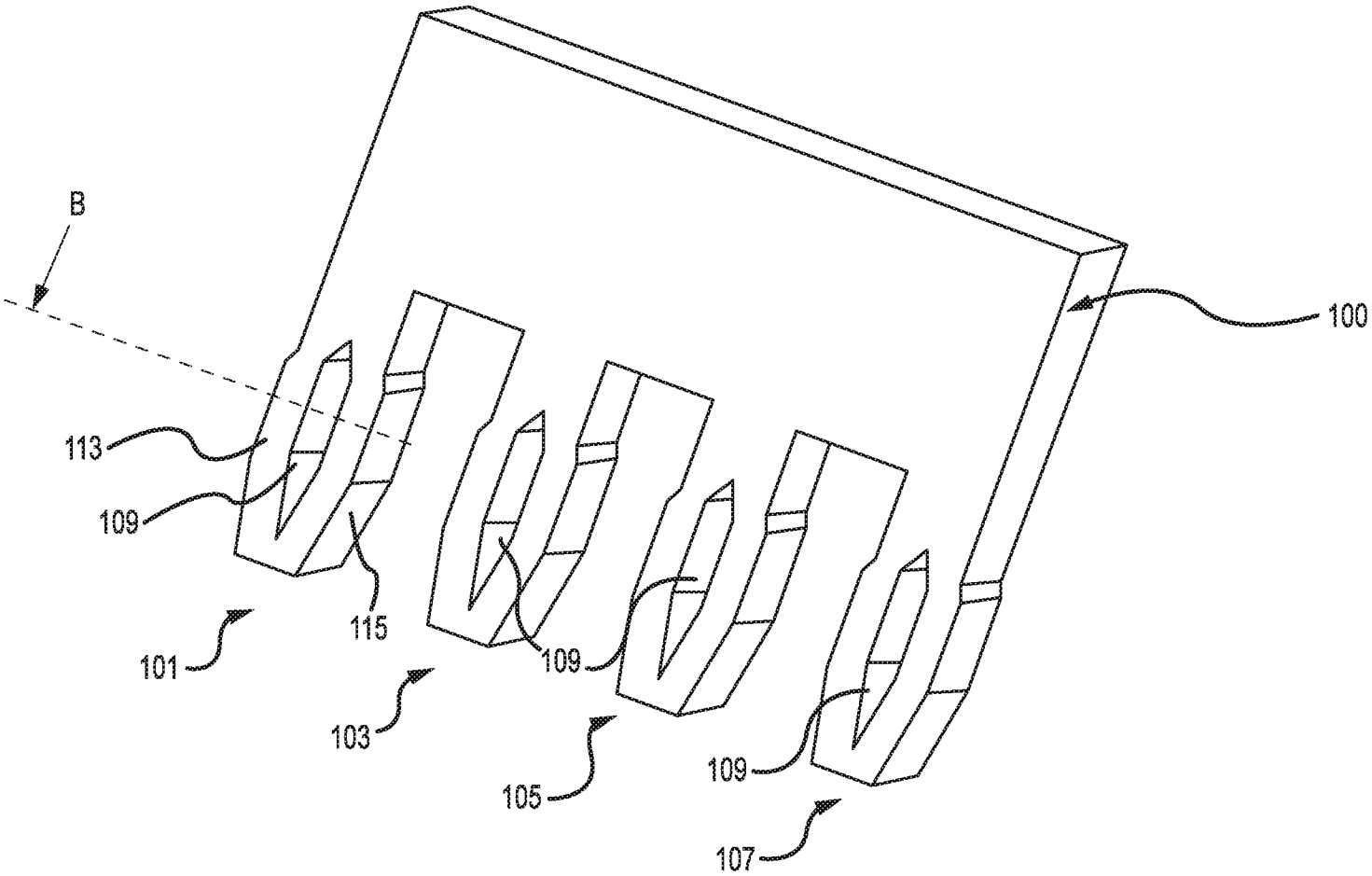
FIG. 1 shoves a loop bridge with a comb-shaped conducting element according to one example.

FIG. 1 shows a loop bridge with a comb-shaped conducting element 100 according to one example. The comb-shaped conducting element 100 includes the prongs 101 to 107. The comb-shaped conducting element 100 is used in the loop bridge for looping through one or more electrical signals.

The loop bridge for looping through a number of electrical signals from a first electric module with a corresponding number of first electric connections to a second electric module with an identical number of second electric connections has and/or uses the comb-shaped conducting element 100 with, for example, that same number of first prongs 101, 103 and the same number of second prongs 105, 107 wherein the first prongs 101, 103 can be inserted into the first electric connections and the second prongs 105, 107 can be inserted into the second electric connections, and wherein the first prongs 101, 103 are connected to the second prongs 105, 107 in an electrically conductive manner.

The number of electrical signals may be a whole number. Examples are the numbers 1, 2, 3, 4, 5, 10 or 25. Furthermore, the number may correspond to a number of poles.

The electrical signals may be control signals used to control the respective electric modules. Furthermore, the electrical signals may be phase signals of a multi-phase signal. One example of a multi-phase signal is a multi-phase supply voltage.

The respective electric module may be a control module for a device, such as a hybrid motor starter and/or a motor manager.

The respective electric module also may comprise, or may be, an electric connection module, specifically a terminal block.

The respective electric connections may be connection terminals of the respective electric module.

The comb-shaped conducting element 100 may be formed by a single-piece, comb-shaped circuit board.

The prongs 101-107 include an aperture 109 in the center of each respective prong. Each prong aperture 109 is limited on its sides by curved side walls 113, 115, which are elastically deformable and which, specifically, are able to be displaced into the respective prong aperture 109, expanding again after the insertion.

The prong aperture 109 may be completely enclosed by the curved side walls 113, 115. The prong aperture 109 also may include an opening on its end, specifically on the side of the prong 101-107 facing away from the comb-shaped conducting element 100, resulting in an elastic fork shape of the prong 101-107.

The prongs' prong apertures 109 may be punched out of the prongs 101-107.

The prongs 101-107 include contact surfaces—not shown in FIG. 1—for electrically contacting electric connections—not shown in FIG. 1.

The first prongs 101, 103 are connected to the respective second prongs 105, 107 in pairs in a conducting manner. For this purpose, the comb-shaped conducting element 100, which may be formed as an FR4 circuit board, may include electrical lines.

Figure 2:
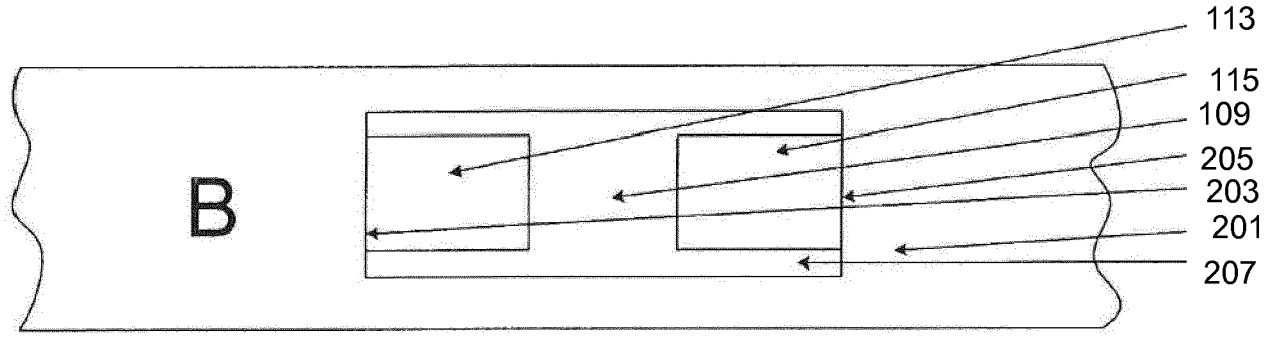
FIG. 2 shows a sectional view of the comb-shaped conducting element.

FIG. 2 shows a diagram of the arrangement of a prong 101-107 in a connection 201 along the intersecting line B from FIG. 1. Each of the respective side walls 113, 115 forms a contact bracket with contact surfaces, which press against the contact surfaces 203, 205 of the interior walls of the connection 201.

In this context, the prong aperture 109 serves as clearance for the deflection of the side walls 113, 115.

The connection 201 may be formed as a current bar with openings 207.

Figure 3:
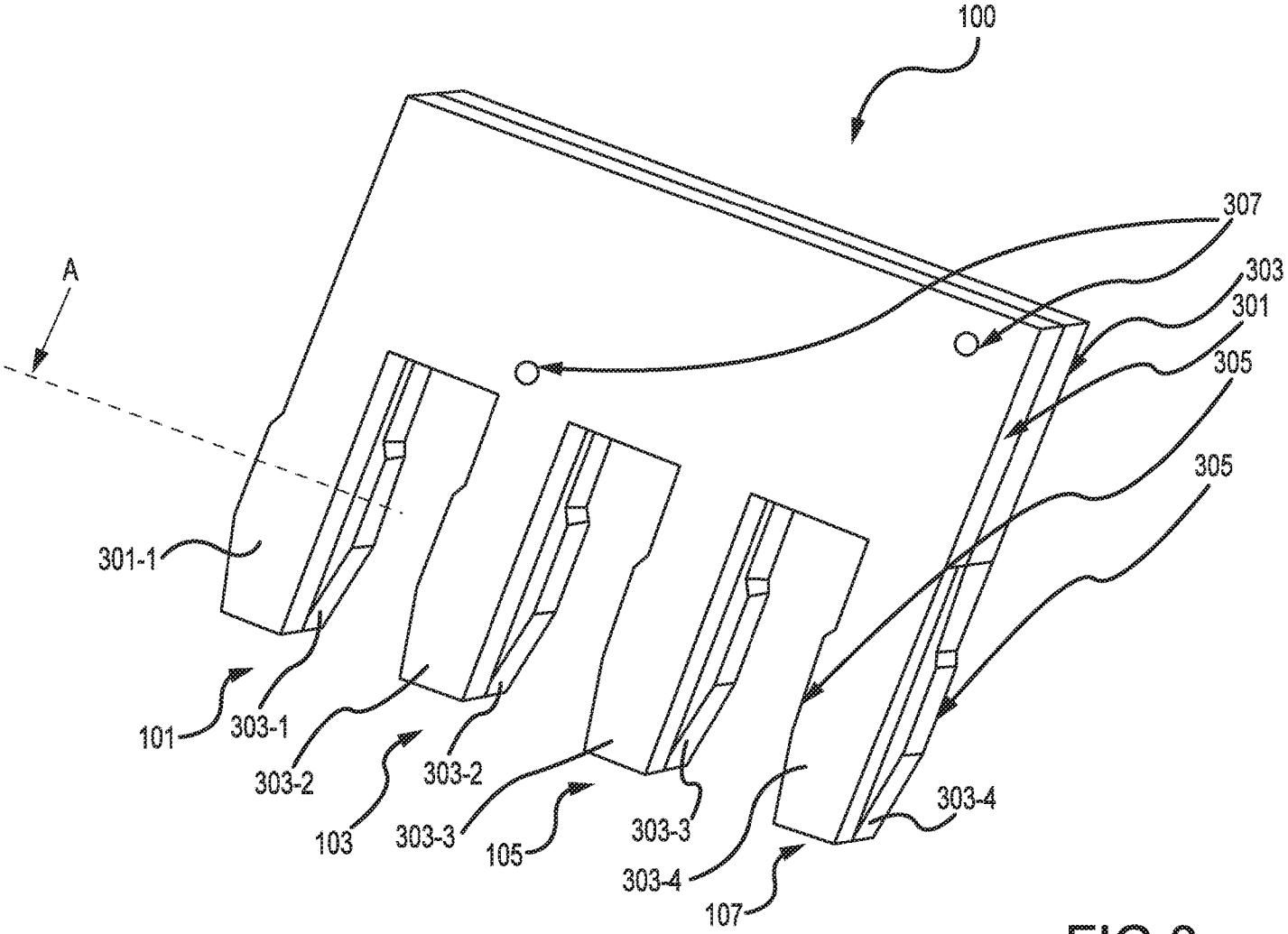
FIG. 3 shows a loop bridge with the comb-shaped conducting element according to another example.

FIG. 3 shows a loop bridge with the comb-shaped conducting element 100 according to another example.

The comb-shaped conducting element 100 includes a first comb-shaped circuit board 301 and a second comb-shaped circuit hoard 303, wherein the first comb-shaped circuit board 301 comprises first partial prongs 301-1, 301-2 and second partial prongs 301-3, 301-4, and wherein the second comb-shaped circuit board 303 comprises first partial prongs 303-1, 303-2 and second partial prongs 303-3, 303-4.

The comb-shaped circuit boards 301 and 303 are positioned on top of each other, such that the first partial prongs

301-1, 301-2 of the first comb-shaped circuit board 301 and the first partial prongs 303-1, 303-2 of the second comb-shaped circuit board 303 are positioned on top of each other. Thus, the pairs of partial prongs including the partial prongs 301-1 and 303-1, as well as 301-2 and 303-2, which respectively are positioned on top of each other, form first prongs 101 and 103.

The second partial prongs 301-3, 301-4 of the first circuit board 301 and the second partial prongs 303-3, 303-4 of the second circuit board 303 also are positioned on top of each other. Thus, the pairs of partial prongs including the partial prongs 301-3 and 303-3, as well as 301-4 and 303-4, which respectively are positioned on top of each other, form second prongs 105, 107.

The partial prongs 301-1 to 301-4 of the first circuit board 301 and the partial prongs 303-1 to 303-4 of the second circuit board 303 are flexible and are laterally movable in relation to each other; specifically, they are bendable. Thus, the combined prongs 101 to 107 can be compressed, such as when inserted into a connection, in which the partial prongs of a partial-prong pair 301-*x*, 303-*x* expand again after the insertion, thus being retained in a force-locking manner.

According to one optional example, each partial prong 301-*x*, 303-*x* includes a lateral curvature 305 on its respective side, such that the lateral curvatures 305 of partial prongs 301-*x*, 303-*x* positioned on top of each other face away from each other, resulting in the force-locking retention of the prong 101-107. The side walls may curve outward in an arched shape or triangular shape or flat shape.

The comb-shaped circuit boards 301 and 303 may include optional fixing point 307, which facilitate joining the comb-shaped circuit boards 301 and 303.

The partial prongs 301-*x*, 303-*x*, are positioned on top of each other, may only overlap partially.

Figure 4:
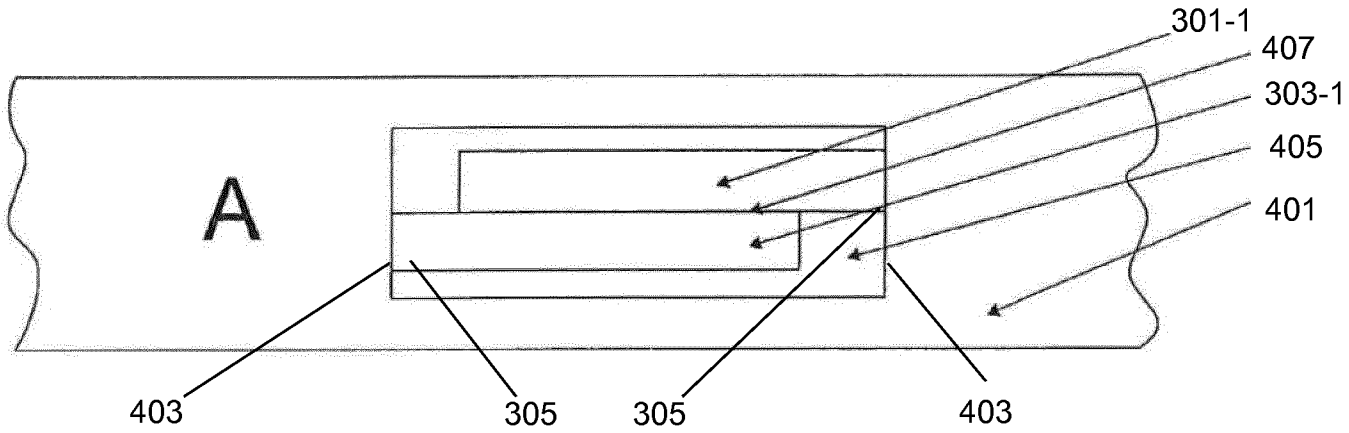
FIG. 4 shows a sectional view of the comb-shaped conducting element.

FIG. 4 shows a sectional view of the first prong 101 along the intersecting line shown in FIG. 3 in a connection 401. In this context, the laterally curving surfaces 305 press against the contact surfaces 403, which are formed on the interior walls of the connection 401. In this context, the laterally curving surfaces 305 may include lateral contact surfaces for making electric contact. The partial prongs 301-*x*, 303-*x*, are separated at the disconnection point 407 and are movable against each other.

The connection 401 may be formed as or in a current bar with current bar openings 405.

The connection between the comb-shaped circuit boards 301 and 303 may be formed by connecting wires, such as FLK connectors, or by SMD pads, which, for example, may be soldered using a reflow process.

Figure 5:
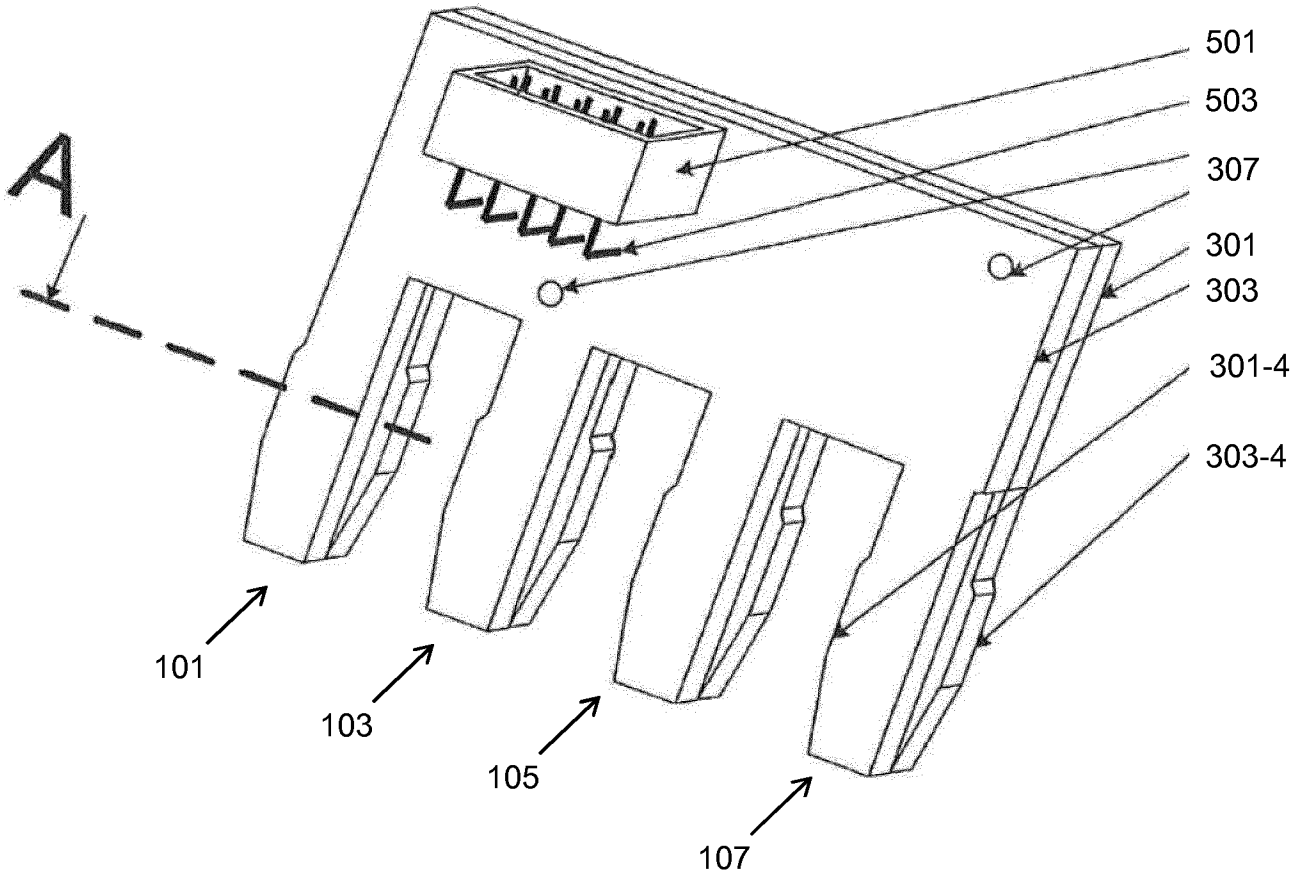
FIG. 5 shows a loop bridge with the comb-shaped conducting element according to another example.

FIG. 5 shows the comb-shaped circuit board element 100 from FIG. 3, which is provided with an interface 501.

The interface 501 includes attached lines 503, which make electric contact with the prongs 101-107.

The interface 501, for example, may realize a point-to-point connection from the prongs 101-107 or from a block to a control.

Figure 6:
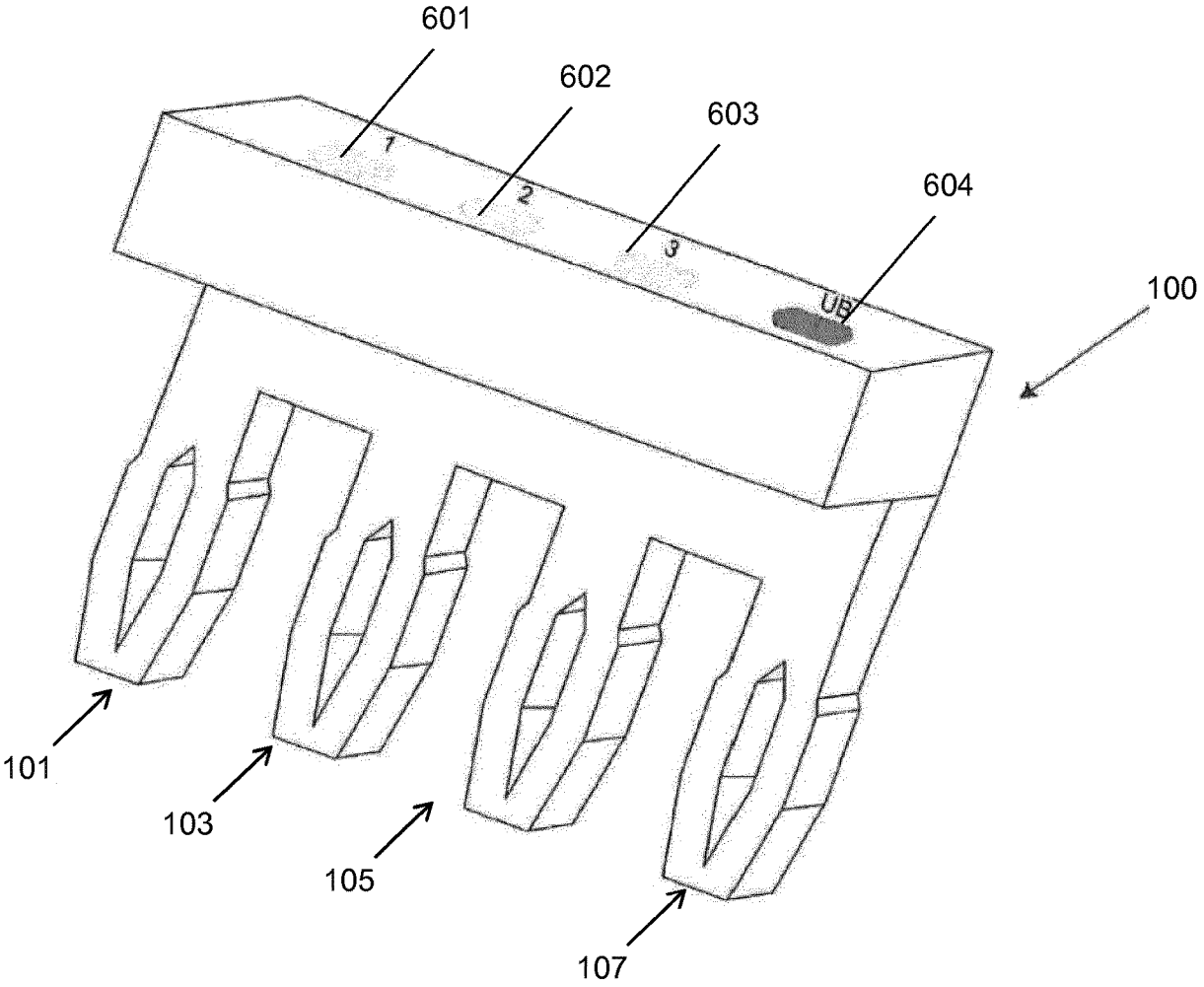
FIG. 6 shows a sectional view of the comb-shaped conducting element.

The comb-shaped conducting element 100 furthermore may include a status indicator 601, 602, 603, 604 for one or each of the prongs 101, 103, 105, 107, as shown in FIG. 6. Thus, an operational status can be visually displayed on the respective prong 101-107, such as is illustrated using the status indicator 604. The respective status indicator 601, 602, 603, 604 may, for example, include an LED and a transparent cover.

Figure 7:
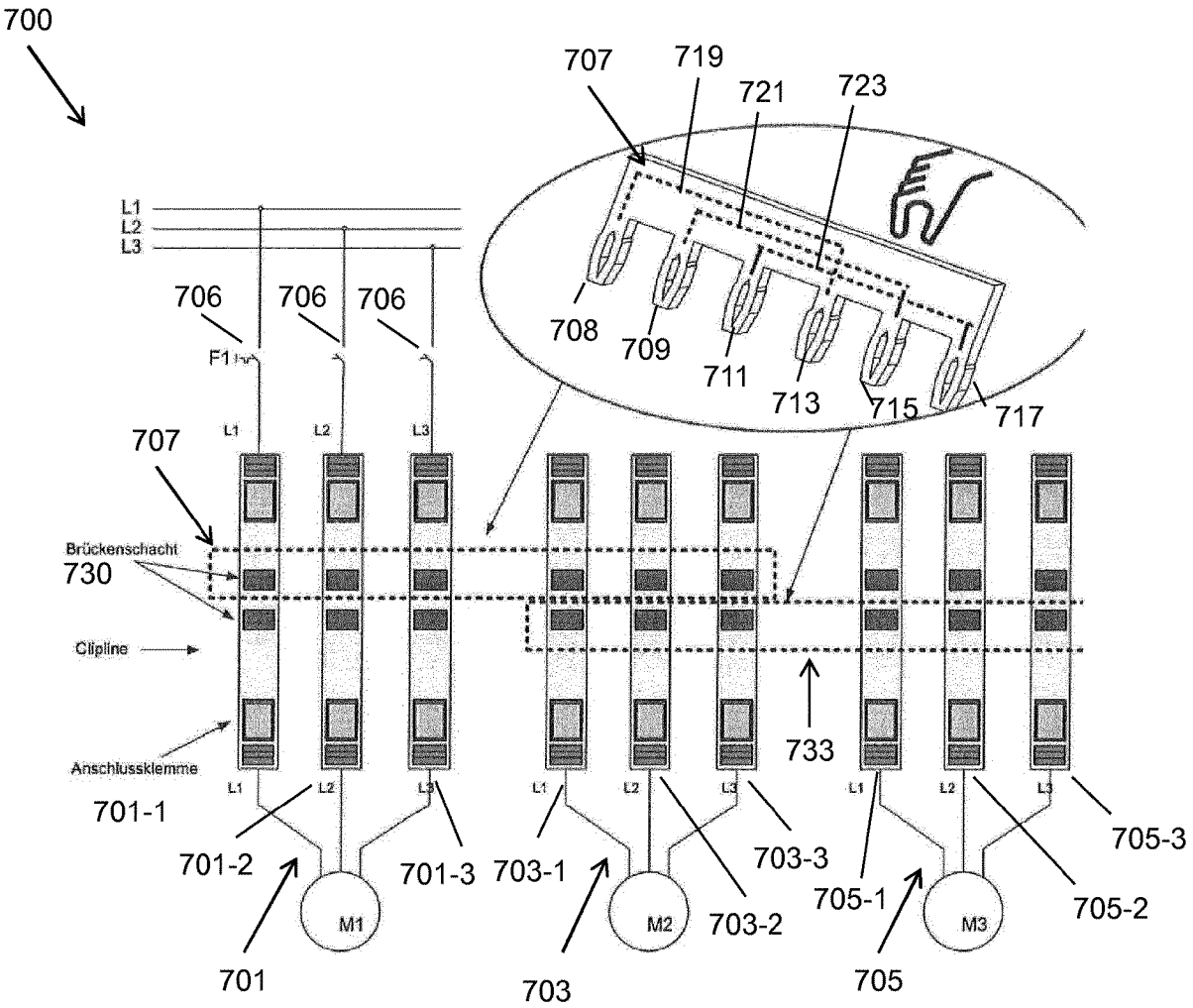
FIG. 7 shows an arrangement of modules.

FIG. 7 shows a connection arrangement 700 according to one example, using the example of a three-phase system with the phases L1, L2 and L3.

The connection arrangement 700, for example, includes a first module 701, a second module 703 and an optional third module 703, which, for example, are connected to supply voltage to electric motors M1, M2 and M3.

The first module 701, for example, may form a terminal block with terminals 701-1, 701-2, 701-3.

The second module 703, for example, may form a terminal block with terminals 703-1, 703-2, 703-3.

The third module 705, for example, may form a terminal block with terminals 705-1, 705-2, 705-3.

The terminals 701-1, 701-2, 701-3 of the first module 701 are connected via fuses 706 to the phases L1, L2 and L3, respectively.

For looping through single-phase signals such as voltages or currents of the phases L1, L2 and L3, for example at the three modules 701, 703, 705, the comb-shaped conducting element 707 is used, which comprises the first prongs 708, 709 and 711, as well as the second prongs 713, 715 and 717.

The comb-shaped conducting element 707, for example, is designed similarly to the comb-shaped conducting elements 100 shown in FIG. 1 and FIG. 3. The only difference is that additional prongs 711, 717 are used for the third phase.

As shown in FIG. 7, the first prongs 708, 709 and 711 are connected in pairs with the second prongs 713, 715 and 717 via lines 719, 721, 723, which may be provided in the comb-shaped conducting element 707. Thus, two additional prongs are located between the prongs electrically connected in pairs, wherein the latter are electrically insulated from the former.

The comb-shaped conducting element 707 can, for example, be manually inserted into the connections 730 or the modules 701 and 703.

An additional comb-shaped conducting element 733, which is indicated in dotted lines, can be used for looping through the phase signals from the second module 703 to the third module 703. The line structures 707 and 733 may be designed identically.

Thus, a three-phase power distribution, a 230V power distribution, a 24V through-connection or a service connection can be realized.

Figure 8:
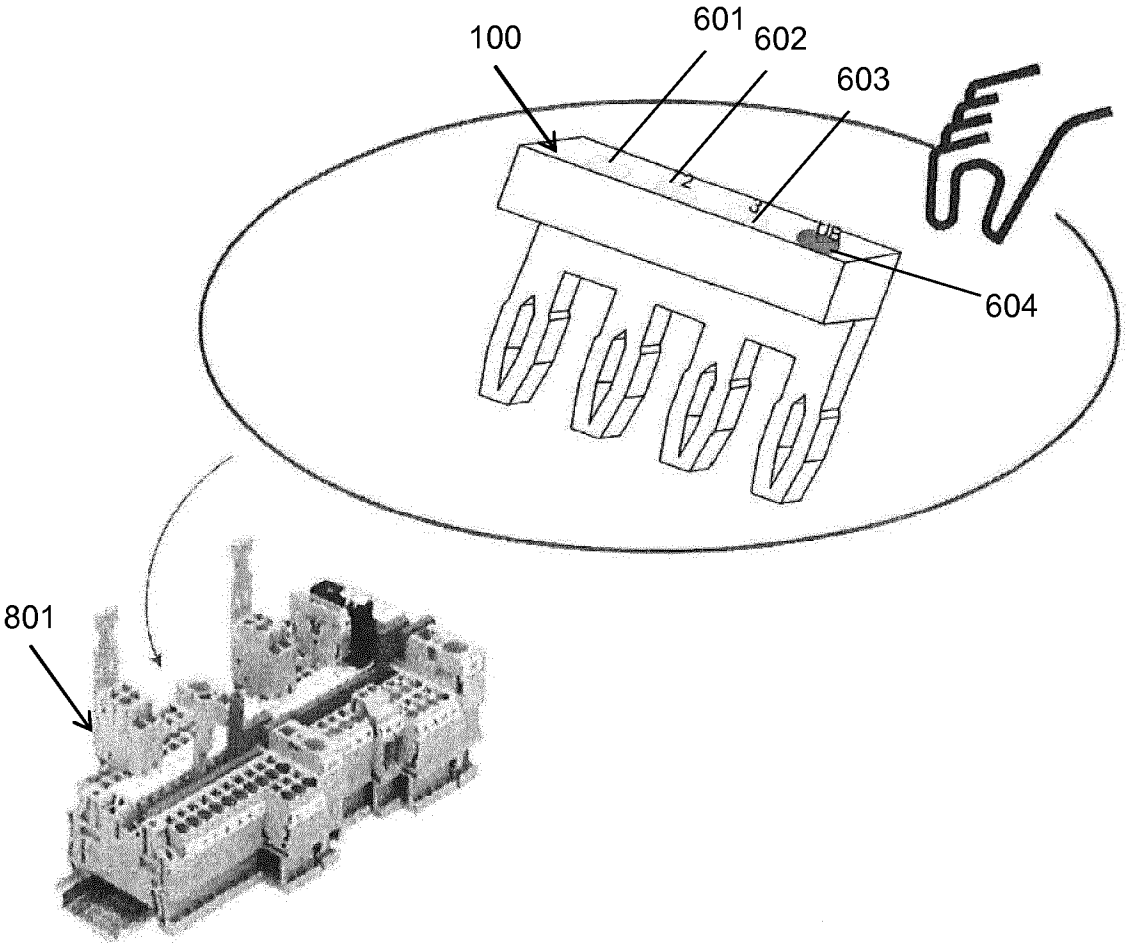
FIG. 8 shows a loop bridge and a module.

FIG. 8 shows an example of the use of the comb-shaped conducting element 100 shown in FIG. 7 for looping through signals in a module 801, which may be a Clipline module, for example. The status indicators 601, 602, 603, 604 show the operating status of the respective connections, which are in contact with the comb-shaped conducting element 100, which is shown in the figure.

LIST OF REFERENCE NUMBERS

100 Comb-shaped conducting element
101 Prong
103 Prong
105 Prong
107 Prong
109 Prong aperture
113 Side wall
115 Side wall
201 Connection
203 Contact surface
205 Contact surface
207 Opening
301 First comb-shaped circuit board
303 Second comb-shaped circuit board
301-*x* Partial prong
303-*x* Partial prong

305 Lateral curvature
307 Fixing point
401 Connection
403 Contact surface
405 Current bar openings
407 Disconnection point
501 Interface
503 Lines
601 Status indicator
602 Status indicator
603 Status indicator
604 Status indicator
700 Connection arrangement
701 Module
701-*x* Terminals
703 Module
703-*x* Terminals
705 Module
705-*x* Terminals
706 Fuse
707 Comb-shaped conducting element
708-717 Prongs
719-723 Lines
730 Connections
733 Comb-shaped conducting element
801 Module

What is claimed is:

1. A loop bridge for looping through a plurality of electrical signals, comprising:

a first electric module comprising a plurality of first electric connections, wherein the plurality of electrical signals are looped through the first electric module to a second electric module comprising a number of second electric connections; and a comb-shaped conducting element comprising a number of first prongs and a number of second prongs, wherein the first prongs are configured to be inserted into the first electric connections and the second prongs are configured to be inserted into the second electric connections, wherein the first prongs are connected to the second prongs in an electrically conductive manner, wherein the first prongs are configured to be elastically deformed to be retained in a force-locking manner in the first electric connections, and the second prongs are configured to be elastically deformed to be retained in a force-locking manner in the second electric connections, wherein the comb-shaped conducting element includes a first comb-shaped circuit board and a second comb-shaped circuit board, wherein the first comb-shaped circuit board comprises first partial prongs and second partial prongs, wherein the second comb-shaped circuit board comprises third partial prongs and fourth partial prongs, wherein the first comb-shaped circuit board and the second comb-shaped circuit board are positioned on top of each other, and the first partial prongs of the first comb-shaped circuit board and the third partial prongs of the second comb-shaped circuit board are at least partially positioned on top of each other, wherein respective pairs of the first and the third partial prongs positioned on top of each other form first prongs, and the second partial prongs of the first comb-shaped circuit board and the fourth partial prongs of the second comb-shaped circuit board are at least partially positioned on top of each other, and wherein respective pairs of the second and the fourth partial prongs positioned on top of each other form second prongs.

2. The loop bridge according to claim 1, wherein at least one prong comprises a prong aperture in the center of the prong, and wherein the prong aperture is defined on its sides by curved side walls, and wherein the curved side walls are configured to be elastically deformed.

3. The loop bridge according to claim 2, wherein the prong aperture is completely enclosed by the curved side walls, or the prong aperture comprises an opening on its end on the side of the prong facing away from the comb-shaped conducting element.

4. The loop bridge according to claim 2, wherein the curved side walls are configured to be elastically displaced during an insertion of the prong into a connection and are configured to be laterally displaced into the prong aperture, and wherein the prong is retained in the connection in a force-locking manner.

5. The loop bridge according to claim 2, wherein the curved side walls curve outward in at least one of an arched shape, a triangular shape, or a flat shape.

6. The loop bridge according to claim 2, wherein the comb-shaped conducting element comprises a single-piece design formed from a comb-shaped circuit board, and wherein the first prongs and the second prongs are formed on the comb-shaped circuit board.

7. The loop bridge according to claim 1, wherein the partial prongs are configured to be elastically deformed, wherein the partial prongs positioned on top of each other are offset against each other, and wherein the prong formed by the partial prongs positioned on top of each other is compressible when inserted into a connection.

8. The loop bridge according to claim 1, wherein the partial prongs positioned on top of each other are configured to be moved or configured to be displaced in relation to each other.

9. The loop bridge according to claim 1, wherein each partial prong comprises a lateral curvature, wherein the lateral curvatures of the partial prongs positioned on top of each other face away from each other, and wherein a respective prong is retained in a force-locking manner in a connection.

10. The loop bridge according to claim 1, wherein the first prongs are connected to the respective second prongs in pairs in an electrically conductive manner, and wherein each prong of the first prongs is connected to a respective prong of the second prongs in an electrically conductive manner.

11. The loop bridge according to claim 1, wherein at least one prone of the first prongs or the second prongs is insulated from a corresponding adjacent prone.

12. The loop bridge according to claim 1, wherein adjacent prongs are spaced apart by a recess configured to accept a bar on a housing of the electric module between two adjacent electric connections.

13. The loop bridge according to claim 1, further comprising:

an interface configured to make electrical contact with the first and the second prongs.

14. The loop bridge according to claim 1, wherein the plurality of electrical signals are phase signals of a multi-phase signal.

15. The loop bridge according to claim 7, wherein the partial prongs configured to be elastically deformed are configured to be compressed and subsequently configured to be expanded.

16. The loop bridge according to claim 12, wherein the recess comprises a rectangular or rounded recess.

17. The loop bridge according to claim 13, wherein the interface comprises a plug-in interface or a USB interface.

18. A connection arrangement for looping through a number of electric signals, the arrangement comprising:

a first electric module comprising a first terminal block comprising a number of first electric connections;

a second electric module comprising a second terminal block comprising a number of second electric connections; and a loop bridge comprising a comb-shaped conducting element with a number of first prongs and second prongs, wherein the first prongs are inserted into the first electric connections and the second prongs are inserted into the second electric connections, wherein the first electric connections are connected to the second electric connections in pairs in an electrically conductive manner, wherein each electric connection of the first electric connections is connected to the respective electric connection of the second electric connections in an electrically conductive manner, wherein the first prongs are retained in the first electric connections by friction and the second prongs are retained in a force locking manner in the second connections.

19. The connection arrangement according to claim 18, wherein at least one prong of the loop bridge comprises a prong aperture in the center of the prong, wherein the prong aperture is defined on its sides by curved side walls, and wherein the curved side walls are configured to be elastically deformed.

* * * * *